US010472994B2

(12) United States Patent
Avadhanula et al.

(10) Patent No.: US 10,472,994 B2
(45) Date of Patent: Nov. 12, 2019

(54) SYSTEMS AND METHODS FOR CONTROLLING THE PRESSURE OF A WORKING FLUID AT AN INLET OF A PRESSURIZATION DEVICE OF A HEAT ENGINE SYSTEM

(71) Applicant: ECHOGEN POWER SYSTEMS LLC, Akron, OH (US)

(72) Inventors: Vamshi Krishna Avadhanula, Tallmadge, OH (US); Timothy Held, Akron, OH (US); Jason D. Miller, Hudson, OH (US); Katherine L. Hart, Shaker Heights, OH (US)

(73) Assignee: ECHOGEN POWER SYSTEMS LLC, Akron, OH (US)

( * ) Notice: Subject to any disclaimer, the term of this patent is extended or adjusted under 35 U.S.C. 154(b) by 0 days.

(21) Appl. No.: 15/988,023

(22) Filed: May 24, 2018

(65) Prior Publication Data

US 2018/0340450 A1 Nov. 29, 2018

Related U.S. Application Data

(60) Provisional application No. 62/511,806, filed on May 26, 2017.

(51) Int. Cl.
*F01K 13/02* (2006.01)
*F01K 25/10* (2006.01)

(52) U.S. Cl.
CPC ..... *F01K 13/02* (2013.01); *F01K 25/10* (2013.01); *F01K 25/103* (2013.01)

(58) Field of Classification Search
CPC ..... F01K 13/02; F01K 25/10; F01K 25/103
USPC ..... 60/646, 657, 660, 661, 693
See application file for complete search history.

(56) References Cited

U.S. PATENT DOCUMENTS

| | | | | |
|---|---|---|---|---|
| 6,588,499 | B1 * | 7/2003 | Fahlsing | F28B 1/06 165/111 |
| 8,015,790 | B2 * | 9/2011 | Zhang | F01K 13/02 60/39.182 |
| 2009/0071156 | A1 * | 3/2009 | Nishikawa | F01K 13/02 60/660 |
| 2014/0102103 | A1 * | 4/2014 | Yamamoto | F01K 15/00 60/658 |
| 2014/0223907 | A1 * | 8/2014 | Fujioka | F01K 9/003 60/645 |

* cited by examiner

*Primary Examiner* — Hoang M Nguyen
(74) *Attorney, Agent, or Firm* — Nolte Intellectual Property Law Group

(57) ABSTRACT

Systems and methods are provided for controlling the pressure of a working fluid at an inlet of a main pressurization device of a heat engine system. The heat engine system may include a control system and a working fluid circuit including a waste heat exchanger, an expansion device, a recuperator, a main pressurization device, and a heat exchanger assembly. The heat exchanger assembly may include a plurality of gas-cooled heat exchangers configured to transfer thermal energy from the working fluid to a cooling medium, a plurality of fans configured to direct the cooling medium into contact with the gas-cooled heat exchangers, and a plurality of drivers, each driver configured to drive a respective fan. The control system may be communicatively coupled to the heat exchanger assembly and configured to modulate a rotational speed of at least one fan to regulate a pressure of the working fluid at the inlet.

20 Claims, 6 Drawing Sheets

SYSTEMS AND METHODS FOR CONTROLLING THE PRESSURE OF A WORKING FLUID AT AN INLET OF A PRESSURIZATION DEVICE OF A HEAT ENGINE SYSTEM

CROSS-REFERENCE TO RELATED APPLICATIONS

This application claims the benefit of U.S. Prov. Appl. No. 62/511,806, filed May 26, 2017. This application is incorporated herein by reference in its entirety to the extent consistent with the present application.

BACKGROUND

Waste heat is often created as a byproduct of industrial processes where flowing streams of high-temperature liquids, gases, or fluids must be exhausted into the environment or removed in some way in an effort to maintain the operating temperatures of the industrial process equipment. Some industrial processes utilize heat exchanger devices to capture and recycle waste heat back into the process via other process streams. However, the capturing and recycling of waste heat is generally infeasible by industrial processes that utilize high temperatures or have insufficient mass flow or other unfavorable conditions.

Waste heat can be converted into useful energy by a variety of turbine generator or heat engine systems that employ thermodynamic methods, such as Rankine and Brayton cycles. Rankine cycles, Brayton cycles, and similar thermodynamic methods are typically steam-based processes that recover and utilize waste heat to generate steam for driving a turbine, turbo, or other expander connected to an electric generator, a pump, or other device.

An organic Rankine cycle utilizes a lower boiling-point working fluid, instead of water, during a traditional Rankine cycle. Exemplary lower boiling-point working fluids include hydrocarbons, such as light hydrocarbons (e.g., propane or butane) and halogenated hydrocarbon, such as hydrochlorofluorocarbons (HCFCs) or hydrofluorocarbons (HFCs) (e.g., R245fa). More recently, in view of issues such as thermal instability, toxicity, flammability, and production cost of the lower boiling-point working fluids, some thermodynamic cycles have been modified to circulate non-hydrocarbon working fluids, such as ammonia.

Typically, in a heat engine system converting waste heat into useful energy, heated working fluid utilized therein is expanded in an expansion device, and the expansion device may convert the thermal energy into mechanical energy. The expanded working fluid may be cooled in a condenser before entering a main compressor of the heat engine system. Those of skill in the art will appreciate that the pressure of the working fluid at the inlet of the main compressor may affect the performance and operation of the heat engine system. Accordingly, one such approach to control the pressure of the working fluid at the inlet of the main compressor provides for the use of a pump and a storage tank including additional working fluid. The additional working fluid from the storage tank may be supplied to the heat engine system via the pump to increase the pressure of the working fluid at the inlet of the main compressor as needed. However, such an approach, while effective, may be impractical based on the allotted space for the heat engine system and the required size of the storage tank to contain enough additional working fluid to adequately control the pressure of the working fluid at the inlet of the main compressor. Further, such an approach requires a high head, high flowrate pump, which increases the complexity and time required to start up and also the operating costs and maintenance of the heat engine system.

Therefore, there is a need for a system and method for controlling the pressure of the working fluid at the inlet of the main compressor or pump of the heat engine system which reduces the footprint of the heat engine system and maximizes the efficiency of transforming thermal energy to mechanical and/or electrical energy.

SUMMARY

Embodiments of the disclosure may provide a heat engine system. The heat engine system may include a control system and a working fluid circuit configured to flow a working fluid therethrough. The working fluid circuit may include a waste heat exchanger, an expansion device, a recuperator, a main pressurization device, and a heat exchanger assembly. The waste heat exchanger may be configured to be in fluid communication and in thermal communication with a heat source stream, and to transfer thermal energy from the heat source stream to the working fluid. The expansion device may be disposed downstream from and in fluid communication with the waste heat exchanger and configured to convert a pressure drop in the working fluid to mechanical energy. The recuperator may be disposed upstream of and in fluid communication with the waste heat exchanger and disposed downstream from and in fluid communication with the expansion device. The main pressurization device may be disposed upstream of and in fluid communication with the recuperator and configured to pressurize and circulate the working fluid within the working fluid circuit. The heat exchanger assembly may be disposed upstream of and in fluid communication with the main pressurization device and disposed downstream from and in fluid communication with the recuperator. The heat exchanger assembly may include a plurality of gas-cooled heat exchangers, a plurality of fans, and a plurality of drivers. The plurality of gas-cooled heat exchangers may be configured to transfer thermal energy from the working fluid to a cooling medium. The plurality of fans may be configured to direct the cooling medium into contact with the plurality of gas-cooled heat exchangers. Each driver of the plurality of drivers may be configured to drive a respective fan of the plurality of fans. The control system may be communicatively coupled to the heat exchanger assembly and configured to modulate a rotational speed of at least one fan of the plurality of fans to control a pressure of the working fluid at an inlet of the main pressurization device.

Embodiments of the disclosure may further provide a heat engine system. The heat engine system may include a main controller and a working fluid circuit configured to flow a working fluid therethrough. The working fluid may include carbon dioxide in a subcritical state and a supercritical state in different locations of the working fluid circuit. The working fluid circuit may include a waste heat exchanger, an expansion device, a recuperator, a main pressurization device, and a heat exchanger assembly. The waste heat exchanger may be configured to be in fluid communication and in thermal communication with a heat source stream, and to transfer thermal energy from the heat source stream to the working fluid. The expansion device may be disposed downstream from and in fluid communication with the waste heat exchanger and configured to convert a pressure drop in the working fluid to mechanical energy. The recuperator may be disposed upstream of and in fluid communication with the waste heat exchanger and disposed downstream from and in fluid communication with the expansion device. The main pressurization device may be disposed upstream of and in fluid communication with the recuperator and configured to pressurize and circulate the working fluid within the working fluid circuit. The heat exchanger assembly may be disposed upstream of and in fluid communication with the main pressurization device and disposed downstream from and in fluid communication with the recuperator. The heat exchanger assembly may include an inlet manifold, an outlet manifold, a plurality of air-cooled heat exchangers, a plurality of fans, a plurality of drivers, and a plurality of driver controllers. The inlet manifold may be in fluid communication with the recuperator, and the outlet manifold may be in fluid communication with the main pressurization device. The plurality of air-cooled heat exchangers may be fluidly connected to the inlet manifold and the outlet manifold and arranged in parallel with one another. The plurality of air-cooled heat exchangers may also be configured to transfer thermal energy from the working fluid to a cooling medium including air. The plurality of fans may be configured to direct the cooling medium into contact with the plurality of air-cooled heat exchangers. Each driver of the plurality of drivers may be configured to drive a respective fan of the plurality of fans. Each driver controller of the plurality of driver controllers may be operatively coupled to a respective driver and configured to modulate a rotational speed of the respective fan. The main controller may be communicatively coupled to the plurality of drive controllers and at least one sensor configured to detect a pressure of the working fluid at an inlet of the main pressurization device. The main controller may also be configured to modulate the rotational speed of one or more of the fans to control the pressure of the working fluid at an inlet of the main pressurization device in response to the detected pressure.

Embodiments of the disclosure may further provide a method for controlling a pressure of a working fluid at an inlet of the main pressurization device of a heat engine system. The method may include circulating the working fluid in a working fluid circuit of a heat engine system via the main pressurization device. The method may also include transferring thermal energy from a heat source stream to the working fluid in a waste heat exchanger of the working fluid circuit. The method may further include expanding the working fluid in an expansion device in fluid communication with the waste heat exchanger. The method may also include detecting the pressure of the working fluid at the inlet of the main pressurization device of the working fluid circuit via one or more sensors. The method may further include modulating a rotational speed of at least one fan configured to direct a cooling medium in contact with a respective gas-cooled heat exchanger of a plurality of gas-cooled heat exchangers of a heat exchanger assembly of the working fluid circuit. Modulating the rotational speed of the at least one fan may include adjusting a thermodynamic quality or density of the working fluid flowing through the heat exchanger assembly based on the detected pressure. The method may also include feeding the working fluid having the adjusted thermodynamic quality or density to the inlet of the main pressurization device, thereby adjusting and controlling the pressure of the working fluid at the inlet of the main pressurization device.

BRIEF DESCRIPTION OF THE DRAWINGS

The present disclosure is best understood from the following detailed description when read with the accompanying Figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
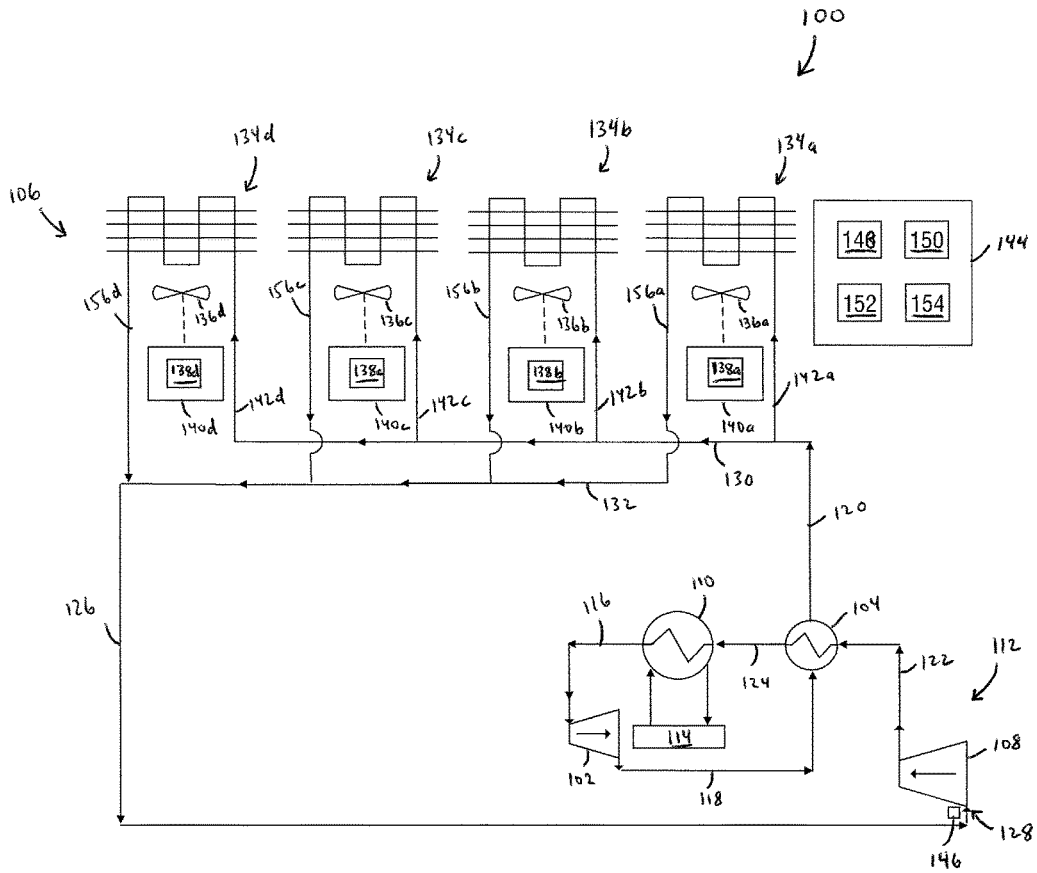
FIG. 1 is a schematic of an exemplary heat engine system, according to one or more embodiments disclosed herein.

It is to be understood that the following disclosure describes several exemplary embodiments for implementing different features, structures, or functions of the invention. Exemplary embodiments of components, arrangements, and configurations are described below to simplify the present disclosure; however, these exemplary embodiments are provided merely as examples and are not intended to limit the scope of the invention. Additionally, the present disclosure may repeat reference numerals and/or letters in the various exemplary embodiments and across the Figures provided herein. This repetition is for the purpose of simplicity and clarity and does not in itself dictate a relationship between the various exemplary embodiments and/or configurations discussed in the various Figures. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Finally, the exemplary embodiments presented below may be combined in any combination of ways, i.e., any element from one exemplary embodiment may be used in any other exemplary embodiment, without departing from the scope of the disclosure.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function. Additionally, in the following discussion and in the claims, the terms "including" and "comprising" are used in an open-ended fashion, and thus should be interpreted to mean "including, but not limited to." All numerical values in this disclosure may be exact or approximate values unless otherwise specifically stated. Accordingly, various embodiments of the disclosure may deviate from the numbers, values, and ranges disclosed herein without departing from the intended scope. Furthermore, as it is used in the claims or specification, the term "or" is intended to encompass both exclusive and inclusive cases, i.e., "A or B" is intended to be synonymous with "at least one of A and B," unless otherwise expressly specified herein.

Embodiments of the disclosure generally provide heat engine systems and methods for transforming energy, such as generating mechanical energy and/or electrical energy from thermal energy. The heat engine systems, as described herein, are configured to efficiently convert thermal energy of a heated stream (e.g., a waste heat stream) into valuable mechanical energy and/or electrical energy. The heat engine systems may utilize the working fluid in a supercritical state (e.g., sc-CO2) or subcritical state contained within the working fluid circuit for capturing or otherwise absorbing thermal energy of the waste heat stream with one or more waste heat exchangers. The thermal energy may be transformed to mechanical energy by an expansion device and subsequently transformed to electrical energy by a generator coupled to the expansion device. The heat engine systems further contain a control system and a heat exchanger assembly utilizing the working fluid contained in the working fluid circuit for controlling the pressure of the working fluid at the inlet of a main pressurization device of each of the heat engine systems.

Turning now to the Figures, FIG. 1 is a schematic of an exemplary heat engine system 100, according to one or more embodiments disclosed herein. The heat engine system 100 is generally configured to encompass one or more elements of a Rankine cycle, a derivative of a Rankine cycle, or another thermodynamic cycle for generating electrical energy from a wide range of thermal sources. To that end, the heat engine system 100 may include an expansion device 102, a recuperator 104, a heat exchanger assembly 106, a main pressurization device 108, and a waste heat exchanger 110 fluidly coupled with one another to form a working fluid circuit 112. The working fluid circuit 112 contains a working fluid for absorbing and transferring thermal energy to components throughout the heat engine system 100. The working fluid circuit 112 may be configured to circulate the working fluid through the expansion device 102, the recuperator 104, the heat exchanger assembly 106, the main pressurization device 108, and the waste heat exchanger 110.

The working fluid circuit 112 may generally have a high pressure side and a low pressure side and may be configured to flow the working fluid through the high pressure side and the low pressure side. As shown in the embodiment of FIG. 1, the high pressure side may extend along the flow path of the working fluid from the main pressurization device 108 to the expansion device 102, and the low pressure side may extend along the flow path of the working fluid from the expansion device 102 to the main pressurization device 108. In some embodiments, working fluid may be transferred from the low pressure side to the high pressure side via a pump bypass valve (not shown).

The thermal energy utilized to generate the mechanical and/or electrical energy may be provided via a waste heat source 114 thermally coupled to the waste heat exchanger 110. The waste heat source 114 may be a stream or exhaust from another system (none shown), such as a system including a gas turbine, furnace, boiler, combustor, nuclear reactor, or the like. Additionally, the waste heat source 114 may be a renewable energy plant, such as a solar heater, geothermal source, or the like. The waste heat exchanger 110 may be configured to transfer thermal energy from waste heat emitted from the waste heat source 114 to the working fluid flowing therethrough, thereby heating the working fluid to a high-temperature, high-pressure working fluid.

The expansion device 102 may be fluidly coupled to and downstream from the waste heat exchanger 110 via line 116 and configured to receive the high-temperature, high-pressure working fluid discharged therefrom. The expansion device 102 may be configured to convert thermal energy stored in the working fluid into rotational energy, which may be employed to power a generator (not shown). As such, the expansion device 102 may be referred to as a power turbine; however, the expansion device 102 may be coupled to other devices in lieu of or in addition to the generator and/or may be used to drive other components of the heat engine system 100 (e.g., the main pressurization device 108) or other systems (not shown). Further, the expansion device 102 may be any suitable expander, such as an axial or radial flow, single or multi-stage, impulse or reaction turbine. The working fluid may also be cooled in the expansion device 102; however, in some embodiments the temperature may remain close to the temperature of the working fluid upstream of the expansion device 102. Accordingly, after pressure reduction, and a limited amount of temperature reduction, the working fluid may exit the expansion device 102 as a high-temperature, low-pressure working fluid.

The recuperator 104 may be any suitable type of heat exchanger, such as a shell-and-tube, plate, fin, printed circuit, or other type of heat exchanger. In one or more embodiments, the recuperator 104 may include at least a heating portion forming part of the high pressure side of the working fluid circuit 112 and a cooling portion forming part of the low pressure side of the working fluid circuit 112. To that end, as shown in FIG. 1, the cooling portion of the recuperator 104 may be fluidly coupled to and disposed downstream of the expansion device 102 via line 118 and upstream of the heat exchanger assembly 106 via line 120. As will be discussed in more detail below, the heating portion of the recuperator 104 may be fluidly coupled to and disposed downstream of the main pressurization device 108 via line 122 and upstream of the waste heat exchanger 110 via line 124. The cooling portion of the recuperator 104 may be configured to transfer at least a portion of the thermal energy in the high-temperature, low-pressure working fluid discharged from the expansion device 102 to another flow of high-pressure working fluid in the heating portion of the recuperator 104, as will be described below. Thus, the flow of working fluid in the cooling portion of the recuperator 104 may be reduced in temperature, resulting in a low/intermediate-temperature, low-pressure working fluid being discharged from the cooling portion of the recuperator 104.

The heat exchanger assembly 106 may be fluidly coupled to and disposed downstream from the cooling portion of the recuperator 104 via line 120 and upstream of the main pressurization device 108 via line 126. The heat exchanger assembly 106 may be configured to control the pressure of the working fluid at an inlet 128 of the main pressurization device 108, thereby allowing for a faster start up and an improved and efficient operation of the heat engine system 100 within a compact footprint. The heat exchanger assembly 106 may further be configured to store a portion of the working fluid in the working fluid circuit 112 while the heat engine system 100 is in stand-by mode, i.e., during periods of inoperativeness. As configured, the heat engine system 100 allows for the removal of or the reduction in size of an external storage tank (not shown) for additional working fluid for use in the operation of the heat engine system 100.

As shown in FIG. 1, the heat exchanger assembly 106 may include an inlet manifold 130, outlet manifold 132, a plurality of gas-cooled heat exchangers (four shown 134*a-d*), a plurality of fans (four shown 136*a-d*), a plurality of driver controllers (four shown 138*a-d*), and a plurality of drivers (four shown 140*a-d*). The inlet manifold 130 may be fluidly coupled with and disposed downstream from the cooling portion of the recuperator 104 via line 120 and upstream of the gas-cooled heat exchangers 134*a-d* via respective lines 142*a-d*. The inlet manifold 130 may be configured to receive and split the low/intermediate-temperature, low-pressure working fluid being discharged from the cooling portion of the recuperator 104 into respective flow portions of the working fluid. As shown in FIG. 1, the gas-cooled heat exchangers 134*a-d* may be arranged in parallel with one another. In one or more embodiments, the respective flow portions may be substantially the same. In other embodiments, the respective flow portions may differ depending on factors, such as, for example, the flow capacity or other operational parameters of the respective gas-cooled heat exchangers 134*a-d*.

Each of the gas-cooled heat exchangers 134*a-d* may be a fin fan heat exchanger or air-cooled heat exchanger and may be configured to increase or decrease the thermodynamic quality (i.e., the amount of vapor) or density of the respective portion of the working fluid flowing therethrough. Although four gas-cooled heat exchangers 134*a-d* are shown in FIG. 1, the present disclosure is not limited thereto, as the number of gas-cooled heat exchangers 134*a-d* utilized may depend, amongst other factors, on the amount of mechanical energy and/or electrical energy generated in the heat engine system. Accordingly, for example, in heat engine systems generating 10 MW of electricity, a heat engine system of the present disclosure may include twenty or more gas-cooled heat exchangers.

Each of the gas-cooled heat exchangers 134*a-d* may be configured to cool the respective portion of the working fluid flowing therethrough via a cooling medium directed thereto via a respective fan 136*a-d* of the plurality of fans 136*a-d*. In one or more embodiments, a plenum (not shown) may be disposed between each fan 136*a-d* and a respective gas-cooled heat exchanger 134*a-d* and configured to direct the cooling medium to and through tube bundles (not shown) of the gas-cooled heat exchanger 134*a-d*. Within each gas-cooled heat exchanger 134*a-d*, the tube bundles may be coupled to headers at both ends thereof, thereby allowing for the working fluid to make several passes through each of the gas-cooled heat exchangers 134*a-d*, as illustrated in FIG. 1. The cooling medium may be ambient air in one or more embodiments. As shown in FIG. 1, each of the fans 136*a-d* may be forced draft, as the cooling medium may be pushed through the respective gas-cooled heat exchanger 134*a-d*; however, the present disclosure is not limited thereto, and in other embodiments, one or more fans 136*a-d* may be induced draft, such that the cooling medium is pulled through the respective gas-cooled heat exchanger 134*a-d*.

Each of the fans 136*a-d* may be driven by a respective driver 140*a-d* of the plurality of drivers 140*a-d*. Each driver 140*a-d* may be a motor and more specifically may be an electric motor, such as a permanent magnet motor, and may include a stator (not shown) and a rotor (not shown). It will be appreciated, however, that other embodiments may employ other types of electric motors including, but not limited to, synchronous motors, induction motors, and brushed DC motors. As shown in FIG. 1, each of the drivers 140*a-d* may be operatively coupled to a respective driver controller 138*a-d* of the plurality of driver controllers 138*a-d* and configured to receive an input from the respective driver controller 138*a-d* corresponding to a desired performance parameter of the respective driver 140*a-d*. For example, the input may be an instruction to increase or decrease a rotational speed of the driver 140*a-d*.

In one or more embodiments, each of the driver controllers 138*a-d* may be a variable frequency drive (VFD) configured to drive the respective driver 140*a-d* by varying the frequency and voltage supplied to the driver 140*a-d*. As is known in the art, frequency (or Hertz) is directly related to the rotational speed (revolutions per minute (RPM)) of the driver 140*a-d*. Accordingly, the drive controller 138*a-d* may be configured to increase the frequency to increase the RPMs of the driver 140*a-d*. Correspondingly, if a decrease in frequency (RPMs) of the driver 140*a-d* is desired, the VFD can be used to ramp down the frequency and voltage to meet the requirements of the load (e.g., fan 136*a-d*) of the driver 140*a-d*. As the desired speed of the driver 140*a-d* changes, the VFD may increase or decrease the speed of the driver 140*a-d* to meet the load demands.

As shown in FIG. 1, each of the driver controllers 138*a-d* may be communicatively coupled, wired and/or wirelessly, with a main controller 144 thereby forming in part a control system configured to control the operation of the heat engine system 100. The control system may further include a plurality of sensors 146 communicatively coupled, wired or wirelessly, with the main controller 144 and/or the driver controllers 138*a-d* in order to process the measured and reported temperatures, pressures, and/or mass flowrates of the working fluid at designated points within the working fluid circuit 112. Designated points in the working fluid circuit 112 may include, but are not limited to, the inlet 128, in the flow path of the cooling medium, and at or within each gas-cooled heat exchanger 134*a-d*. In response to these measured and/or reported parameters, the control system may be operable to selectively adjust the pressure of the working fluid at the inlet 128 of the main pressurization device 108 in accordance with a control program or algorithm, thereby maximizing operation of the heat engine system 100.

Specifically, in one or more embodiments, the main controller 144 may include one or more processors 148 configured to monitor the pressure of the working fluid at the inlet 128 of the main pressurization device 108 via one or more sensors 146 and to determine if the pressure at the inlet 128 should be increased, decreased, or maintained to optimize the performance of the heat engine system 100. To that end, the main controller 144 may transmit one or more instructions via signals to one or more of the driver controllers 138*a-d* to increase, decrease, or maintain the RPMs of the respective drivers 140*a-d*.

For example, in a determination by the main controller 144 that the pressure at the inlet 128 of the main pressurization device 108 is to be decreased in response to a pressure detection by the sensor(s) 146, the main controller 144 may send one or more instructions via one or more signals to at least one driver controller 138*a-d* to increase the speed (RPMs) of the respective driver(s) 140*a-d*. The increase in RPMs of the driver(s) 140*a-d* may increase the flow rate of the cooling medium generated by the fan(s) 136*a-d* operatively coupled to the driver(s) 140*a-d*. The thermodynamic quality of the working fluid may decrease (amount of vapor decreases) or density increase, thereby decreasing the pressure at the inlet 128 of the main pressurization device 108.

In another example, in a determination by the main controller 144 that the pressure at the inlet 128 of the main pressurization device 108 is to be increased in response to a pressure detection by the sensor(s) 146, the main controller 144 may send one or more instructions via one or more signals to at least one driver controller 138*a-d* to decrease the frequency (RPMs) of the respective driver(s) 140*a-d*. The decrease in frequency (RPMs) of the driver(s) 140*a-d* may decrease the flow rate of the cooling medium generated by the fan(s) 136*a-d* operatively coupled to the driver(s) 140*a-d*. The thermodynamic quality of the working fluid may increase (amount of vapor increases) or density increase, thereby increasing the pressure at the inlet 128 of the main pressurization device 108.

Accordingly, the pressure at the inlet 128 of the main pressurization device 108 may be increased or decreased by adjusting the frequency (RPMs) of one or more drivers 140*a-d*, thus increasing or decreasing the flow rate of the cooling medium across the gas-cooled heat exchangers 134*a-d*. By doing so, the thermodynamic quality or density of the working fluid may be increased or decreased, thereby affecting the pressure at the inlet 128 of the main pressurization device 108.

The processor(s) 148 may be configured to execute the operating system, programs, interfaces, and any other functions of the main controller 144. The processor(s) 148 may also include one or more microprocessors and/or related chip sets, a computer/machine readable memory capable of storing date, program information, or other executable instructions thereon, general purpose microprocessors, special purpose microprocessors, or a combination thereof, on board memory for caching purposes, instruction set processors, and so forth.

The main controller 144 may also include one or more input/output (I/O) ports 150 that enable the main controller 144 to couple to one or more external devices (e.g., external data sources). An I/O controller 152 may provide the infrastructure for exchanging data between the processor(s) 148 and external devices connected through the I/O ports 150 and/or for receiving user input through one or more input devices (not shown).

A storage device 154 may store information, such as one or more programs and/or instructions, used by the processor(s) 148, the main controller 144 and/or the drive controllers 138*a-d*, the I/O controller 152, or a combination thereof. For example, the storage device 154 may store firmware for the main controller 144, programs, applications, or routines executed by the main controller 144, processor functions, etc. The storage device 154 may include one or more non-transitory, tangible, machine-readable media, such as read-only memory (ROM), random access memory (RAM), solid state memory (e.g., flash memory), CD-ROMs, hard drives, universal serial bus (USB) drives, any other computer readable storage medium, or any combination thereof. The storage media may store encoded instructions, such as firmware, that may be executed by the processer(s) 146 to operate the logic or portions of the logic presented in the methods disclosed herein.

The control system formed via the drive controllers 138*a-d*, the main controller 144, and the sensors 146 may operate over a network and may also include a network device (not shown) for communication with external devices over the network, such as a Local Area Network (LAN), Wide Area Network (WAN), or the Internet and may be powered by a power source (not shown). The power source may be an alternating current (AC) power source (e.g., an electrical outlet), a portable energy storage device (e.g., a battery or battery pack), a combination thereof, or any other suitable source of available power. Further, in certain embodiments, some or all of the components of the main controller 144 may be provided in a housing, which may be configured to support and/or enclose some or all of the components of the main controller 144.

The outlet manifold 132 of the heat exchanger assembly 106 may be fluidly coupled with and disposed downstream from each of the gas-cooled heat exchangers 134*a-d* via lines 156*a-d* and upstream of the main pressurization device 108 via line 126. Accordingly, the outlet manifold 132 may be configured to collect the respective flow portions of the working fluid discharged from the gas-cooled heat exchangers 134*a-d* and to provide the collected working fluid to the main pressurization device 108 via line 126. As the heat exchanger assembly 106 may be configured to adjust the thermodynamic quality or density of the working fluid, the collected working fluid in line 126 may be a thermally adjusted working fluid.

The main pressurization device 108 may be configured to receive the thermally adjusted working fluid from the heat exchanger assembly 106, such that the inlet 128 of the main pressurization device is adjusted to or maintained at the desired pressure to optimize the performance of the heat engine system 100. The main pressurization device 108 may be further configured to circulate or pressurize the working fluid within the working fluid circuit 112. In addition, in some embodiments, the main pressurization device 108 may be configured to compress the thermally adjusted working fluid. Thus, in some embodiments, the main pressurization device 108 may be a compressor. In other embodiments, the main pressurization device may be a pump.

Based on the foregoing, the thermally adjusted working fluid received from the heat exchanger assembly 106 may be pressurized, and in some embodiments compressed, and discharged to the heating portion of the recuperator 104 via line 122. The heating portion of the recuperator 104 may be configured to transfer thermal energy from the cooling portion of the recuperator 104, thereby heating the working fluid. The working fluid may be discharged from the heating portion of the recuperator 104 to the waste heat exchanger 110 via line 116. The working fluid may be heated in the waste heat exchanger 110 via the waste heat provided from the waste heat source 114 and the cycle may be repeated.

Figure 2:
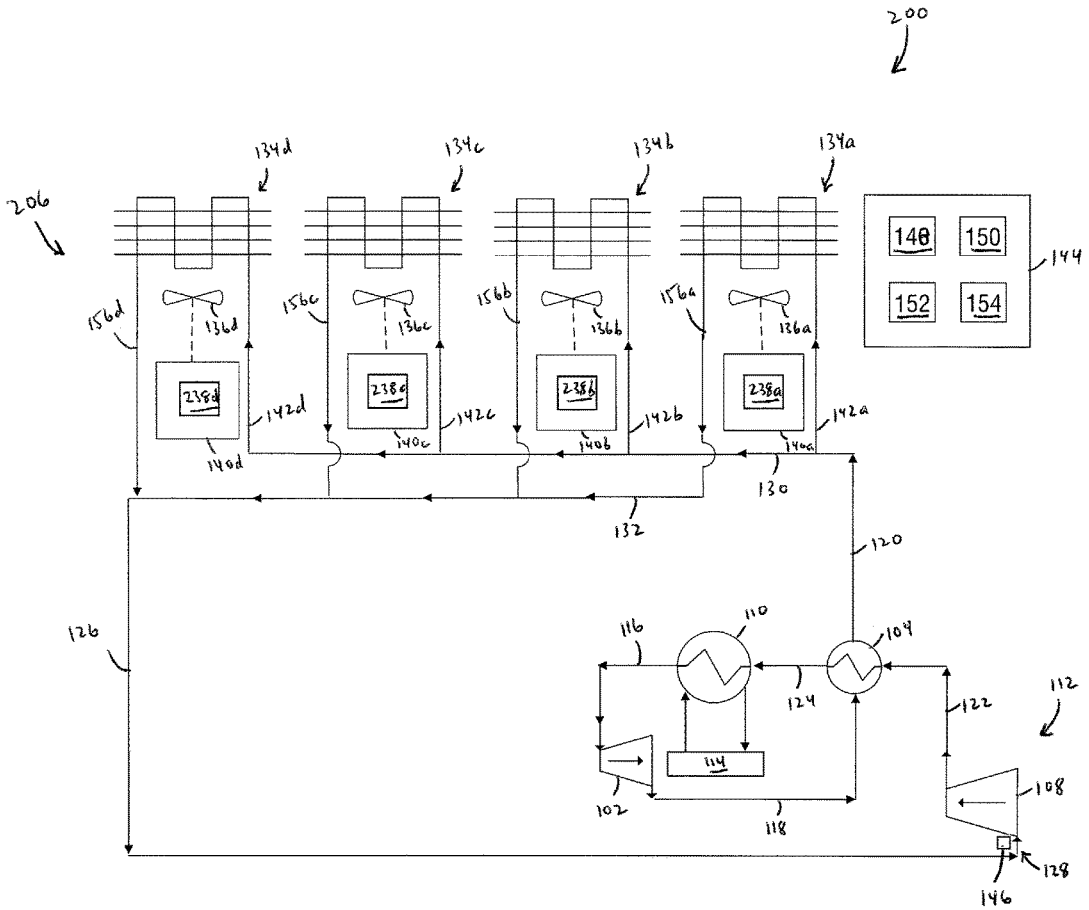
FIG. 2 is a schematic of another exemplary heat engine system, according to one or more embodiments disclosed herein.

Referring now to FIG. 2 with continued reference to FIG. 1, FIG. 2 is a schematic of another exemplary heat engine system 200, according to one or more embodiments disclosed herein. The heat engine system 200 may be similar in some respects to the heat engine system 200 described above and thus may be best understood with reference to FIG. 1 and the description thereof, where like numerals designate like components and will not be described again in detail. As shown in FIG. 2, the heat engine system 200 includes a heat exchanger assembly 206. The heat exchanger assembly 206 may include drive controllers 238-*d* configured to selectively activate the respective drivers 140*a-d*.

Each of the drive controllers 238*a-d* may be a switch configured to energize or de-energize the respective driver 140*a-d*, which in turn may energize or de-energize the respective fan 136*a-d*. Therefore, in the embodiment of FIG. 2, the drivers 140*a-d* may either operate in either of two states: on or off. Accordingly, the drive controllers 238*a-d* may only provide for the operation of the drivers 140*a-d* at 0 RPMs or at maximum RPMs. Thus, the main controller 144 may adjust the thermodynamic quality or density of working fluid at the inlet 128 of the main pressurization device 108 by selectively turning on or off each driver 140*a-d* as necessary to achieve the desired pressure at the inlet 128. In one or more embodiments, the thermodynamic quality or density of the working fluid may be controlled by switching the drivers 140*a-d* selectively on or off in sequence via the drive controllers 238*a-d*.

For example, in a determination by the main controller 144 that the pressure at the inlet 128 of the main pressurization device 108 is to be increased in response to a pressure detection by the sensor(s) 146, the main controller 144 may send one or more instructions via one or more signals starting with the driver controller (driver controller 238*d*) disposed most downstream from the inlet manifold 130 to shut off the respective driver) 140*d*. The de-energizing of the driver 140*d* may stop the flow of the cooling medium generated by the fan 136*d* operatively coupled to the driver 140*d*. The thermodynamic quality of the working fluid may increase (amount of vapor increases) or density decrease, thereby increasing the pressure at the inlet 128 of the main pressurization device 108.

In another example, in a determination by the main controller 144 that the pressure at the inlet 128 of the main pressurization device 108 is to be decreased in response to a pressure detection by the sensor(s) 146, the main controller 144 may send one or more instructions via one or more signals starting with the driver controller (driver controller 238*a*) disposed immediately downstream from the inlet manifold 130 to energize the respective driver) 140*a*. The energizing of the driver 140*a* may increase the flow of the cooling medium generated by the fan 136*a* operatively coupled to the driver 140*a*. The thermodynamic quality of the working fluid may decrease (amount of vapor decreases) or density increase, thereby decreasing the pressure at the inlet 128 of the main pressurization device 108.

Figure 3:
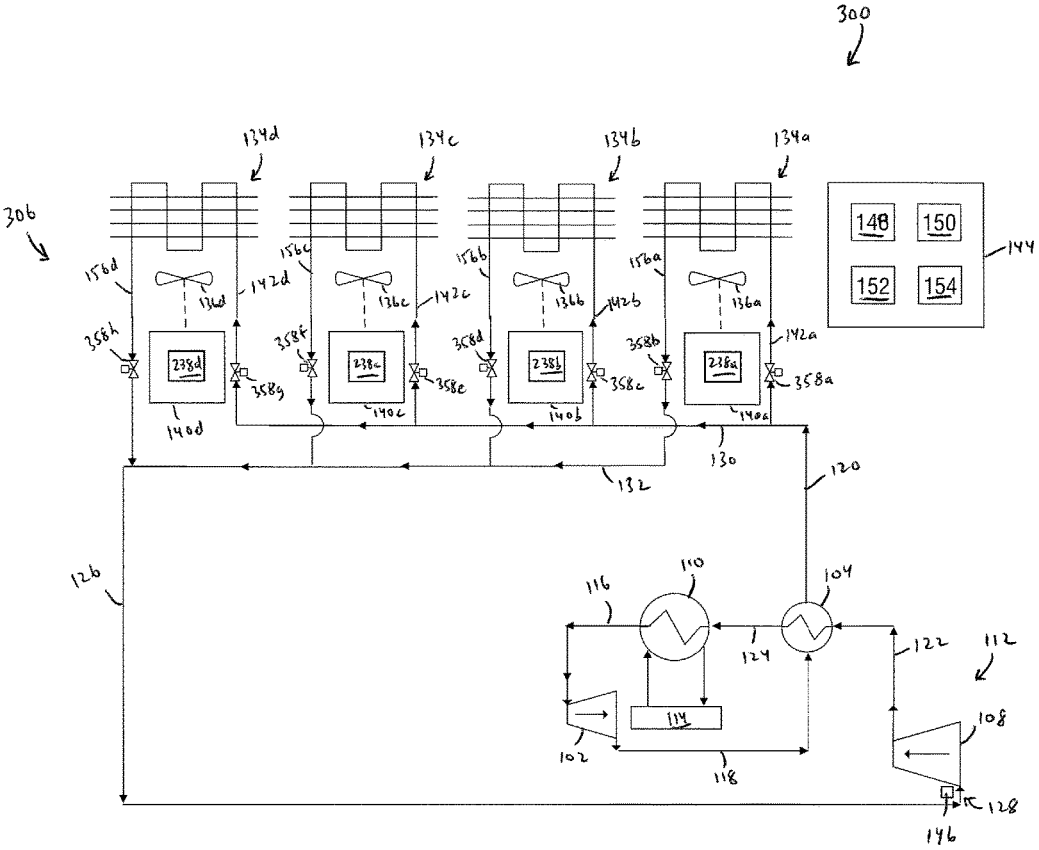
FIG. 3 is a schematic of another exemplary heat engine system, according to one or more embodiments disclosed herein.

Referring now to FIG. 3 with continued reference to FIGS. 1 and 2, FIG. 3 is a schematic of another exemplary heat engine system 300, according to one or more embodiments disclosed herein. The heat engine system 300 may be similar in some respects to the heat engine systems 100 and 200 described above and thus may be best understood with reference to FIGS. 1 and 2 and the description thereof, where like numerals designate like components and will not be described again in detail. As shown in FIG. 3, the heat engine system 300 includes a heat exchanger assembly 306. The heat exchanger assembly 306 may include drive controllers 238*a-d* configured to selectively activate the respective drivers 140*a-d* and may further include a plurality of valves 358*a-h* communicatively coupled to the main controller 144 and configured to selectively isolate the respective gas-cooled heat exchangers 134*a-d* from the working fluid circuit 112. In one or more embodiments, each of the valves 358*a-h* may be coupled to lines 142*a-d* and 156*a-d* and fluidly coupled to the inlet manifold 130 and the outlet manifold 132, such that the valves 358*a-h* may selectively isolate one or more of the gas-cooled heat exchangers 134*a-d* from the remainder of the working fluid circuit 112.

One or more of the gas-cooled heat exchangers 134*a-d* may be isolated from the remainder of the working fluid circuit 112 to adjust the pressure of working fluid at the inlet 128 of the main pressurization device 108. For example, in a determination by the main controller 144 that the pressure at the inlet 128 of the main pressurization device 108 is to be increased in response to a pressure detection by the sensor(s) 146, the main controller 144 may send one or more instructions via one or more signals to a pair of valves 358*a* and 358*b* to isolate gas-cooled heat exchanger 134*a*. In addition, the main controller 144 144 may send one or more instructions via one or more signals to the driver controller 238*a* to shut off the respective driver 140*a*. The de-energizing of the driver 140*a* may stop the flow of the cooling medium generated by the fan 136*a* operatively coupled to the driver 140*a*. As the capacity for cooling in the heat exchanger assembly 106 is decreased by isolating the gas-cooled heat exchanger 134*a*, the thermodynamic quality of the working fluid in the remained of the heat exchanger assembly 106 may increase (amount of vapor increases) or density decrease, thereby increasing the pressure at the inlet 128 of the main pressurization device 108.

In another example, in a determination by the main controller 144 that the pressure at the inlet 128 of the main pressurization device 108 is to be decreased in response to a pressure detection by the sensor(s) 146, the main controller 144 may send one or more instructions via one or more signals to the pair of closed valves 358*a* and 358*b* to open the valves 358*a* and 358*b* such that the gas-cooled heat exchanger may communicate with the remainder of the working fluid circuit 112. In addition, the main controller 144 144 may send one or more instructions via one or more signals to the driver controller 238*a* to turn on the respective driver 140*a*. The energizing of the driver 140*a* may increase the flow of the cooling medium generated by the fan 136*a* operatively coupled to the driver 140*a*. The thermodynamic quality of the working fluid may decrease (amount of vapor decreases) or density increase, thereby decreasing the pressure at the inlet 128 of the main pressurization device 108.

Figure 4:
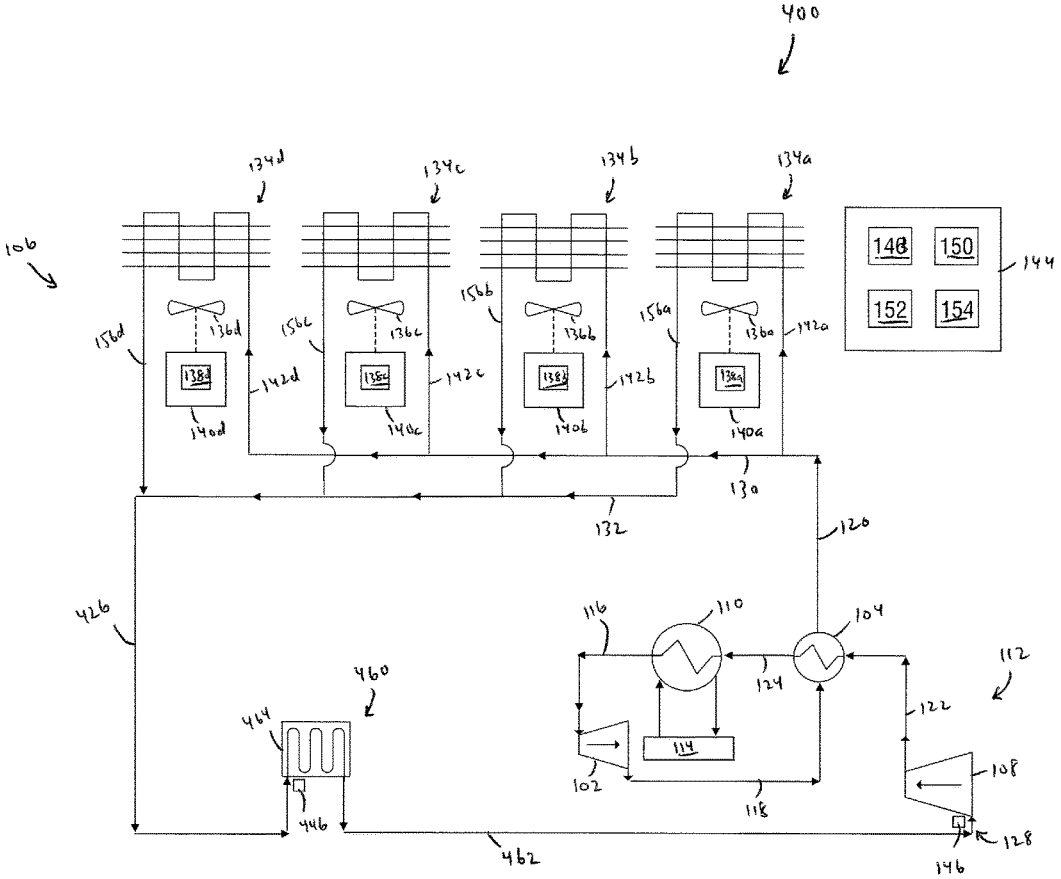
FIG. 4 is a schematic of another exemplary heat engine system, according to one or more embodiments disclosed herein.

Referring now to FIG. 4 with continued reference to FIGS. 1-3, FIG. 4 is a schematic of another exemplary heat engine system 400, according to one or more embodiments disclosed herein. The heat engine system 400 may be similar in some respects to the heat engine systems 100, 200, 300 described above and thus may be best understood with reference to FIGS. 1-3 and the description thereof, where like numerals designate like components and will not be described again in detail. As shown in FIG. 4, the heat engine system 400 includes the heat exchanger assembly 106. However, in other embodiments, the heat engine system may include either the heat exchanger assembly 206 or the heat exchanger assembly 306 in place of the heat exchanger assembly 106.

The heat engine system 400 further includes a refrigeration system 460 forming part of the working circuit 112. The refrigeration system 460 may be fluidly coupled with and disposed downstream from the outlet manifold 132 via line 426 and upstream of the main pressurization device via line 462. The refrigeration system 460 may include a refrigeration loop including an evaporator, a condenser, a compressor, and a heat exchanger 464. The heat exchanger may be configured to transfer thermal energy from the working fluid to a refrigerant flowing through the refrigeration loop.

The refrigerant may be utilized in the refrigerant system 460 by the heat exchanger 464 for cooling the working fluid and removing thermal energy outside of the working fluid circuit 112. The refrigerant flows through, over, or around while in thermal communication with the heat exchanger 464. Thermal energy in the working fluid is transferred to the refrigerant via the heat exchanger 464. Therefore, the refrigerant is in thermal communication with the working fluid circuit 112, but not fluidly coupled to the working fluid circuit 112. The heat exchanger 464 may be fluidly coupled to the working fluid circuit 112 and independently fluidly coupled to the refrigerant. The refrigerant may contain one or multiple compounds and may be in one or multiple states of matter. The refrigerant may be a media or fluid in a gaseous state, a liquid state, a subcritical state, a supercritical state, a suspension, a solution, derivatives thereof, or combinations thereof.

The refrigeration system 460 may operate to more finely tune the pressure of the working fluid at the inlet 128 of the main pressurization device 108 by increasing or decreasing the thermodynamic quality or density of the working fluid passing through the refrigeration system 460. For example, the pressure of the adjusted working fluid discharged from any of the heat exchanger assemblies 106, 206, 306 may be detected via one or more sensors 446 disposed inside or adjacent the refrigeration system 460 to measure and report the pressure, temperature, mass flowrate, or other properties of the working fluid within the refrigeration system 460. The main controller 144 may determine that the thermodynamic quality or density of the working fluid may need further adjustments to provide the desired pressure at the inlet 128 of the main pressurization device 108. Accordingly, in the event that a decrease in pressure is needed, the main controller 144 may send one or more instructions via one or more signals to the refrigeration system 460 to circulate the refrigerant through the refrigerant loop, thereby cooling the working fluid flowing through the heat exchanger 464 and decreasing the thermodynamic quality or increasing the density of the working fluid, thereby decreasing the pressure at the inlet 128 of the main pressurization device 108.

Figure 5:
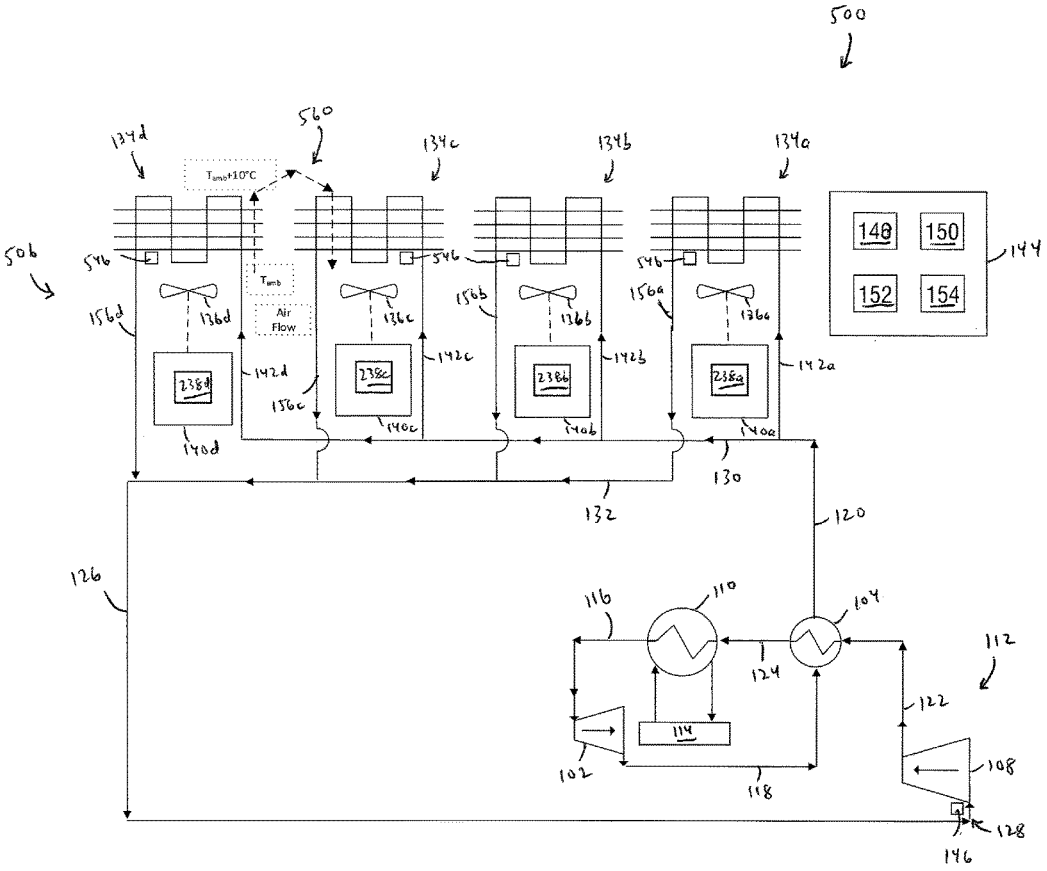
FIG. 5 is a schematic of another exemplary heat engine system, according to one or more embodiments disclosed herein.

Referring now to FIG. 5 with continued reference to FIGS. 1 and 2, FIG. 5 is a schematic of another exemplary heat engine system 500, according to one or more embodiments disclosed herein. The heat engine system 500 may be similar in some respects to the heat engine systems 100, 200 described above and thus may be best understood with reference to FIGS. 1 and 2 and the description thereof, where like numerals designate like components and will not be described again in detail. As shown in FIG. 5, the heat engine system 500 includes a heat exchanger assembly 506. The heat exchanger assembly 506 as shown in FIG. 5 is similar to the heat exchanger assembly 206 of FIG. 2 and further includes an external heating system 560 to add heat to one or more of the gas-cooled heat exchangers 134*a-d*. The external heating system 560 may include ducting or louvers directing heat from heat source (the exhausted cooling medium of one gas-cooled heat exchanger 134*a-d*) to another gas-cooled heat exchanger 134*a-d* in a counter flow direction, thereby heating the working fluid flowing through the gas-cooled heat exchanger 134*a-d*. In another embodiment, the heat source may be an electric heater or process flow.

One or more sensors 546 may be disposed inside or adjacent the gas-cooled heat exchangers 134*a-d* to measure and report the pressure, temperature, mass flowrate, or other properties of the working fluid within the gas-cooled heat exchangers 134*a-d*. In one embodiment, the main controller 144 may determine that the thermodynamic quality or density of the working fluid may need further adjustments to provide the desired pressure at the inlet 128 of the main pressurization device 108. Accordingly, in the event that an increase in pressure is needed, the main controller 144 may send one or more instructions via one or more signals to the external heat system 560 to direct additional heat from the heat source to the gas-cooled heat exchanger 134*a-d*, thereby increasing the thermodynamic quality, or decreasing the density, of the working fluid and the pressure of the inlet 128 at the main pressurization device 108.

Figure 6:
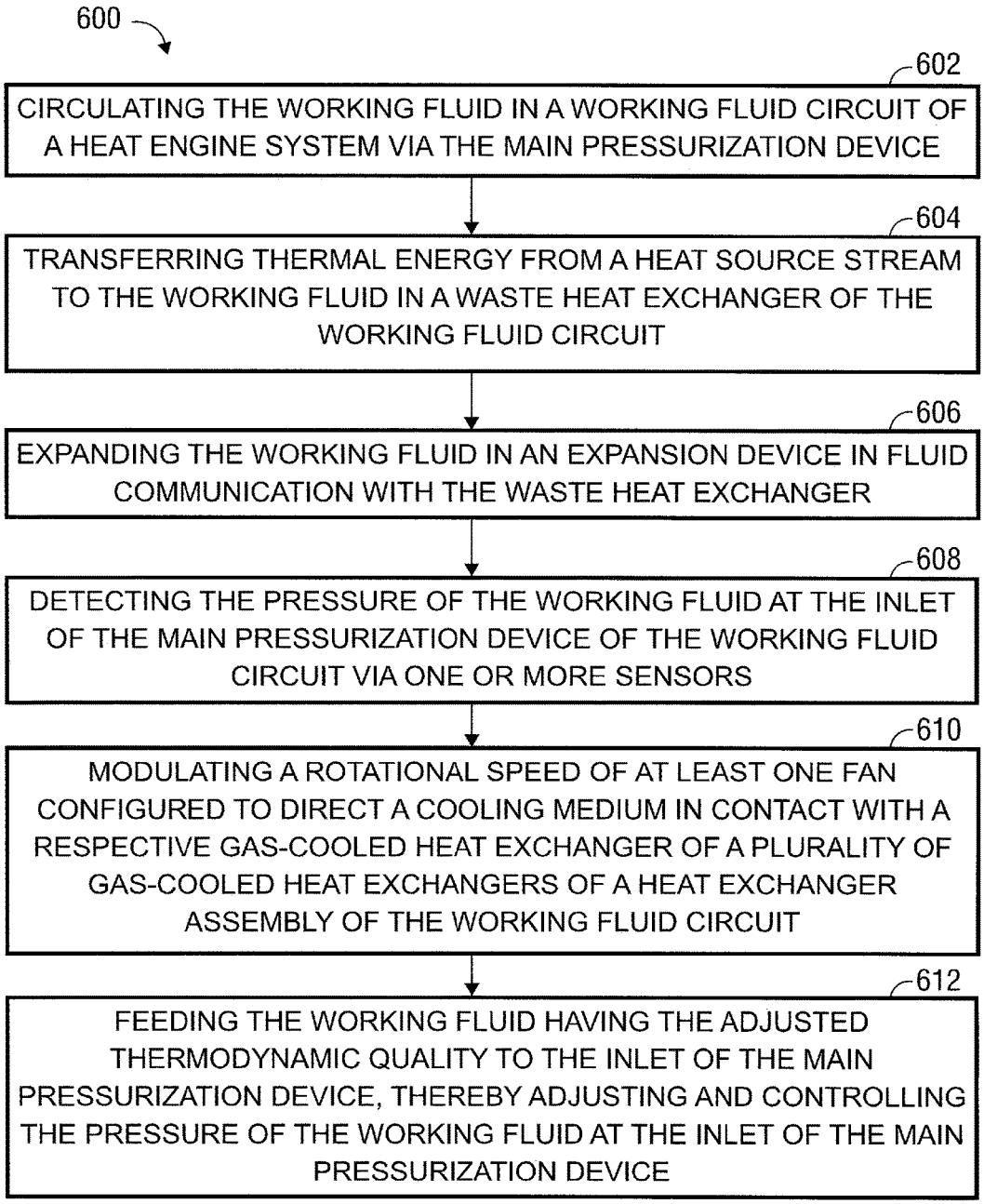
FIG. 6 is a flowchart depicting a method for controlling the pressure of the working fluid at the inlet of the compressor of the heat engine system, according to one or more embodiments disclosed herein.

FIG. 6 illustrates a flowchart of an exemplary method 600 for controlling the pressure of the working fluid at the inlet of the compressor of the heat engine system, according to one or more embodiments disclosed herein. The method 600 may proceed by operation of either of the heat engine systems 100, 200, 300, 400, 500 and may thus be best understood with reference thereto. The method 600 may include circulating the working fluid in a working fluid circuit of a heat engine system via the main pressurization device, as at 602. The method 600 may also include transferring thermal energy from a heat source stream to the working fluid in a waste heat exchanger of the working fluid circuit, as at 604.

The method 600 may further include expanding the working fluid in an expansion device in fluid communication with the waste heat exchanger, as at 606. The method 600 may also include detecting the pressure of the working fluid at the inlet of the main pressurization device of the working fluid circuit via one or more sensors, as at 608. The method 600 may further include modulating a rotational speed of at least one fan configured to direct a cooling medium in contact with a respective gas-cooled heat exchanger of a plurality of gas-cooled heat exchangers of a heat exchanger assembly of the working fluid circuit, as at 610. Modulating the rotational speed of the at least one fan may include adjusting a thermodynamic quality or density of the working fluid flowing through the heat exchanger assembly based on the detected pressure. The method 600 may also include feeding the working fluid having the adjusted thermodynamic quality or density to the inlet of the main pressurization device, thereby adjusting and regulating the pressure of the working fluid at the inlet of the main pressurization device, as at 612.

In some embodiments, the types of working fluid that may be circulated, flowed, or otherwise utilized in the working fluid circuit 112 of the heat engine systems 100, 200, 300, 400, 500 include or may contain carbon oxides, hydrocarbons, alcohols, ketones, halogenated hydrocarbons, ammonia, amines, aqueous, or combinations thereof. Exemplary working fluids that may be utilized in the working fluid circuits 112 include carbon dioxide, ammonia, methane, ethane, propane, butane, ethylene, propylene, butylene, acetylene, methanol, ethanol, acetone, methyl ethyl ketone, water, derivatives thereof, or mixtures thereof. Halogenated hydrocarbons may include hydrochlorofluorocarbons (HCFCs), hydrofluorocarbons (HFCs) (e.g., 1,1,1,3,3-pentafluoropropane (R245fa)), fluorocarbons, derivatives thereof, or mixtures thereof.

In many embodiments described herein, the working fluid the working fluid circulated, flowed, or otherwise utilized in the working fluid circuit 112 may be or may contain carbon dioxide ($CO_2$) and mixtures containing carbon dioxide. Generally, at least a portion of the working fluid circuit 112 contains the working fluid in a supercritical state (e.g., sc-$CO_2$). Carbon dioxide utilized as the working fluid or contained in the working fluid for power generation cycles has many advantages over other compounds typical used as working fluids, since carbon dioxide has the properties of being non-toxic and non-flammable and is also easily available and relatively inexpensive. Due in part to a relatively high working pressure of carbon dioxide, a carbon dioxide system may be much more compact than systems using other working fluids. The high density and volumetric heat capacity of carbon dioxide with respect to other working fluids makes carbon dioxide more "energy dense" meaning that the size of all system components can be considerably reduced without losing performance. It should be noted that use of the terms carbon dioxide ($CO_2$), supercritical carbon dioxide (sc-$CO_2$), or subcritical carbon dioxide (sub-$CO_2$) is not intended to be limited to carbon dioxide of any particular type, source, purity, or grade. For example, industrial grade carbon dioxide may be contained in and/or used as the working fluid without departing from the scope of the disclosure.

In other exemplary embodiments, the working fluid in the working fluid circuit 112 may be a binary, ternary, or other working fluid blend. The working fluid blend or combination can be selected for the unique attributes possessed by the fluid combination within a heat recovery system, as described herein. For example, one such fluid combination includes a liquid absorbent and carbon dioxide mixture enabling the combined fluid to be pumped in a liquid state to high pressure with less energy input than required to compress carbon dioxide. In another exemplary embodiment, the working fluid may be a combination of carbon dioxide (e.g., sub-$CO_2$ or sc-$CO_2$) and one or more other miscible fluids or chemical compounds. In yet other exemplary embodiments, the working fluid may be a combination of carbon dioxide and propane, or carbon dioxide and ammonia, without departing from the scope of the disclosure.

In some embodiments, the working fluid circuit 112 may have a high pressure side and a low pressure side and contain the working fluid in multiple states or phases of matter throughout various portions of the working fluid circuit 112. The use of the term "working fluid" is not intended to limit the state or phase of matter of the working fluid. For instance, the working fluid or portions of the working fluid may be in a liquid phase, a gas phase, a fluid phase, a subcritical state, a supercritical state, or any other phase or state at any one or more points within the working fluid circuit 112.

Generally, the high pressure side of the working fluid circuit 112 contains the working fluid (e.g., sc-$CO_2$) at a pressure of about 15 MPa or greater, such as about 17 MPa or greater or about 20 MPa or greater. In some examples, the high pressure side of the working fluid circuit 112 may have a pressure within a range from about 15 MPa to about 30 MPa, more narrowly within a range from about 16 MPa to about 26 MPa, more narrowly within a range from about 17 MPa to about 25 MPa, and more narrowly within a range from about 17 MPa to about 24 MPa, such as about 23.3 MPa. In other examples, the high pressure side of the working fluid circuit 112 may have a pressure within a range from about 20 MPa to about 30 MPa, more narrowly within a range from about 21 MPa to about 25 MPa, and more narrowly within a range from about 22 MPa to about 24 MPa, such as about 23 MPa.

The low pressure side of the working fluid circuit 112 contains the working fluid (e.g., $CO_2$ or sub-$CO_2$) at a pressure of less than 15 MPa, such as about 12 MPa or less or about 10 MPa or less. In some examples, the low pressure side of the working fluid circuit 112 may have a pressure within a range from about 4 MPa to about 14 MPa, more narrowly within a range from about 6 MPa to about 13 MPa, more narrowly within a range from about 8 MPa to about 12 MPa, and more narrowly within a range from about 10 MPa to about 11 MPa, such as about 10.3 MPa. In other examples, the low pressure side of the working fluid circuit 112 may have a pressure within a range from about 2 MPa to about 10 MPa, more narrowly within a range from about 4 MPa to about 8 MPa, and more narrowly within a range from about 5 MPa to about 7 MPa, such as about 6 MPa.

In some examples, the high pressure side of the working fluid circuit 112 may have a pressure within a range from about 17 MPa to about 23.5 MPa, and more narrowly within a range from about 23 MPa to about 23.3 MPa while the low pressure side of the working fluid circuit 112 may have a pressure within a range from about 8 MPa to about 11 MPa, and more narrowly within a range from about 10.3 MPa to about 11 MPa.

The foregoing has outlined features of several embodiments so that those skilled in the art may better understand the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions and alterations herein without departing from the spirit and scope of the present disclosure.

The invention claimed is:

1. A heat engine system, comprising:

a working fluid circuit configured to flow a working fluid therethrough, the working fluid circuit comprising:

a waste heat exchanger configured to be in fluid communication and in thermal communication with a heat source stream, and to transfer thermal energy from the heat source stream to the working fluid;

an expansion device disposed downstream from and in fluid communication with the waste heat exchanger and configured to convert a pressure drop in the working fluid to mechanical energy;

a recuperator disposed upstream of and in fluid communication with the waste heat exchanger and disposed downstream from and in fluid communication with the expansion device;

a main pressurization device disposed upstream of and in fluid communication with the recuperator and configured to pressurize and circulate the working fluid within the working fluid circuit; and a heat exchanger assembly disposed upstream of and in fluid communication with the main pressurization device and disposed downstream from and in fluid communication with the recuperator, the heat exchanger assembly comprising:

a plurality of gas-cooled heat exchangers configured to transfer thermal energy from the working fluid to a cooling medium;

a plurality of fans configured to direct the cooling medium into contact with the plurality of gas-cooled heat exchangers; and a plurality of drivers, each driver configured to drive a respective fan of the plurality of fans; and a control system communicatively coupled to the heat exchanger assembly and configured to modulate a rotational speed of at least one fan of the plurality of fans to regulate a pressure of the working fluid at an inlet of the main pressurization device.

2. The heat engine system of claim 1, wherein the heat exchanger assembly further comprises a plurality of driver controllers, each driver controller operatively coupled to a respective driver and configured to modulate the rotational speed of the respective fan driven by the respective driver.

3. The heat engine system of claim 2, wherein the control system further comprises a main controller communicatively coupled to each of the driver controllers and configured to transmit one or more instructions to at least one controller to modulate the rotational speed of the respective fan in order to regulate the pressure of the working fluid at the inlet of the main pressurization device.

4. The heat engine system of claim 3, wherein each driver controller is a variable frequency drive.

5. The heat engine system of claim 3, wherein each driver controller is a switch positionable in a first state and a second state, wherein the switch as positioned in the first state energizes the respective driver, and the switch as positioned in the second state de-energizes the respective driver.

6. The heat engine system of claim 5, wherein the heat exchanger assembly further comprises a plurality of valves communicatively coupled to the main controller and disposed upstream of and downstream from each of the gas-cooled heat exchangers, the plurality of valves configured to selectively isolate one or more of the gas-cooled heat exchangers from a remainder of the working fluid circuit in order to regulate the pressure of the working fluid at the inlet of the main pressurization device.

7. The heat engine system of claim 3, wherein the control system further comprises at least one sensor communicatively coupled to the main controller and configured to detect the pressure of the working fluid at the inlet of the main pressurization device.

8. The heat engine system of claim 1, wherein the working fluid circuit further comprises a refrigeration system disposed upstream of and in fluid communication with the main pressurization device and disposed downstream from and in fluid communication with the heat exchanger assembly, the refrigeration system comprising an auxiliary heat exchanger configured to be in fluid communication and in thermal communication with a refrigerant stream and to transfer thermal energy from the working fluid to the refrigerant stream in order to regulate the pressure of the working fluid at the inlet of the main pressurization device.

9. The heat engine system of claim 8, wherein the heat exchanger assembly is further configured to store at least a portion of the working fluid therein during a period of inoperativeness of the heat engine system.

10. The heat engine system of claim 1, wherein the heat exchanger assembly further comprises a heating system configured to be in fluid communication and in thermal communication with a heat source and to transfer thermal energy from the heat source to the working fluid in order to regulate the pressure of the working fluid at the inlet of the main pressurization device.

11. The heat engine system of claim 1, wherein each of the gas-cooled heat exchangers is a fin fan heat exchanger, and the cooling medium comprises air.

12. The heat engine system of claim 1, wherein the working fluid comprises carbon dioxide in a subcritical state and a supercritical state in different locations of the working fluid circuit.

13. A heat engine system, comprising:

a working fluid circuit configured to flow a working fluid therethrough comprising carbon dioxide in a subcritical state and a supercritical state in different locations of the working fluid circuit, the working fluid circuit comprising:

a waste heat exchanger configured to be in fluid communication and in thermal communication with a heat source stream, and to transfer thermal energy from the heat source stream to the working fluid;

an expansion device disposed downstream from and in fluid communication with the waste heat exchanger and configured to convert a pressure drop in the working fluid to mechanical energy;

a recuperator disposed upstream of and in fluid communication with the waste heat exchanger and disposed downstream from and in fluid communication with the expansion device;

a main pressurization device disposed upstream of and in fluid communication with the recuperator and configured to pressurize and circulate the working fluid within the working fluid circuit; and a heat exchanger assembly disposed upstream of and in fluid communication with the main pressurization device and disposed downstream from and in fluid communication with the recuperator, the heat exchanger assembly comprising:

an inlet manifold in fluid communication with the recuperator;

an outlet manifold in fluid communication with the main pressurization device;

a plurality of air-cooled heat exchangers fluidly connected to the inlet manifold and the outlet manifold and arranged in parallel with one another, the plurality of air-cooled heat exchangers configured to transfer thermal energy from the working fluid to a cooling medium including air;

a plurality of fans configured to direct the cooling medium into contact with the plurality of air-cooled heat exchangers;

a plurality of drivers, each driver configured to drive a respective fan of the plurality of fans; and a plurality of driver controllers, each driver controller operatively coupled to a respective driver and configured to modulate a rotational speed of the respective fan; and a main controller communicatively coupled to the plurality of drive controllers and at least one sensor configured to detect a pressure of the working fluid at an inlet of the main pressurization device, the main controller configured to modulate the rotational speed of one or more of the fans to control the pressure of the working fluid at an inlet of the main pressurization device in response to the detected pressure.

14. The heat engine system of claim 13, wherein each driver controller is (i) a variable frequency drive, or (ii) a switch positionable in a first state and a second state, wherein the switch as positioned in the first state energizes the respective driver, and the switch as positioned in the second state de-energizes the respective driver.

15. The heat engine system of claim 13, wherein the heat exchanger assembly further comprises a plurality of valves communicatively coupled to the main controller and disposed upstream of and downstream from each of the air-cooled heat exchangers, the plurality of valves configured to selectively isolate one or more of the air-cooled heat exchangers from the inlet manifold and the outlet manifold in order to control the pressure of the working fluid at the inlet of the main pressurization device.

16. The heat engine system of claim 13, wherein the working fluid circuit further comprises a refrigeration system disposed upstream of and in fluid communication with the main pressurization device and disposed downstream from and in fluid communication with the heat exchanger assembly, the refrigeration system comprising an auxiliary heat exchanger configured to be in fluid communication and in thermal communication with a refrigerant stream and to transfer thermal energy from the working fluid to the refrigerant stream in order to control the pressure of the working fluid at the inlet of the main pressurization device.

17. The heat engine system of claim 13, wherein the heat exchanger assembly further comprises a heating system configured to be in fluid communication and in thermal communication with a heat source and to transfer thermal energy from the heat source to the working fluid in order to control the pressure of the working fluid at the inlet of the main pressurization device.

18. A method for controlling a pressure of a working fluid at an inlet of a main pressurization device of a heat engine system, the method comprising:

circulating the working fluid in a working fluid circuit of a heat engine system via the main pressurization device;

transferring thermal energy from a heat source stream to the working fluid in a waste heat exchanger of the working fluid circuit;

expanding the working fluid in an expansion device in fluid communication with the waste heat exchanger;

detecting the pressure of the working fluid at the inlet of the main pressurization device of the working fluid circuit via one or more sensors;

modulating a rotational speed of at least one fan configured to direct a cooling medium in contact with a respective gas-cooled heat exchanger of a plurality of gas-cooled heat exchangers of a heat exchanger assembly of the working fluid circuit, wherein modulating the rotational speed of the at least one fan comprises adjusting a thermodynamic quality or density of the working fluid flowing through the heat exchanger assembly based on the detected pressure; and feeding the working fluid having the adjusted thermodynamic quality or density to the inlet of the main pressurization device, thereby adjusting and controlling the pressure of the working fluid at the inlet of the main pressurization device.

19. The method of claim 18, further comprising transmitting one or more instructions based on the detected pressure to at least one driver controller operatively coupled to a driver configured to drive the at least one fan, wherein the at least one driver controller is a variable frequency drive or a switch.

20. The method of claim 18, further comprising adjusting a plurality of valves of the heat exchanger assembly to selectively isolate one or more gas-cooled heat exchangers of the heat exchanger assembly from a remainder of the working fluid circuit, wherein each of the gas-cooled heat exchangers is fluid coupled to an inlet manifold and an outlet manifold of the heat exchanger assembly, and the plurality of gas-cooled heat exchangers are disposed in parallel with one another in the working fluid circuit.

* * * * *